US008887403B2

(12) United States Patent
Sekiguchi et al.

(10) Patent No.: US 8,887,403 B2
(45) Date of Patent: Nov. 18, 2014

(54) MEDIUM PROCESSING DEVICE

(75) Inventors: Takahisa Sekiguchi, Nagano (JP); Takuya Maruo, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 297 days.

(21) Appl. No.: 13/490,446

(22) Filed: Jun. 6, 2012

(65) Prior Publication Data

US 2012/0312228 A1 Dec. 13, 2012

(30) Foreign Application Priority Data

Jun. 10, 2011 (JP) ..... 2011-130181
Jun. 14, 2011 (JP) ..... 2011-132642

(51) Int. Cl.
*B43L 13/00* (2006.01)
*B26F 1/38* (2006.01)
*B26D 5/02* (2006.01)

(52) U.S. Cl.
CPC ..... *B26F 1/3813* (2013.01); *B26D 5/02* (2013.01)
USPC ..... 33/18.1

(58) Field of Classification Search
USPC ..... 33/18.1; 101/93.07; 118/35, 37, 40, 42
See application file for complete search history.

(56) References Cited

U.S. PATENT DOCUMENTS

| | | | | | |
|---|---|---|---|---|---|
| 4,157,552 | A * | 6/1979 | Nakajima | 346/141 |
| 4,228,570 | A * | 10/1980 | Chamberlin et al. | 29/33 R |
| 4,577,409 | A * | 3/1986 | Sakamoto et al. | 33/18.1 |
| 4,640,222 | A * | 2/1987 | Gerber | 118/697 |
| 4,709,483 | A * | 12/1987 | Hembree et al. | 33/18.1 |
| 5,383,277 | A * | 1/1995 | Shimoda et al. | 33/18.1 |
| 5,482,389 | A * | 1/1996 | Bickoff et al. | 400/621 |
| 5,505,552 | A * | 4/1996 | Hasegawa et al. | 400/621 |
| 8,336,214 | B2 * | 12/2012 | Kawaguchi et al. | 33/18.1 |
| 2003/0183165 | A1 * | 10/2003 | Kakimoto et al. | 118/35 |

FOREIGN PATENT DOCUMENTS

| | | |
|---|---|---|
| JP | 06-262899 | 9/1994 |
| JP | 08-224993 | 9/1996 |

* cited by examiner

*Primary Examiner* — Christopher Fulton
(74) *Attorney, Agent, or Firm* — Jianq Chyun IP Office

(57) ABSTRACT

An object of the invention is to provide a medium processing device which carries out a plurality of processes, such as plotting and cutting, on a medium, such as paper, wherein there is no need to attach and detach units which carry out the plurality of processes, thus simplifying the structure of the device. A medium processing device, which carries out two kinds of processes on paper with a pen and a cutter, includes a carriage including a pen holder which holds the pen, a cutter holder which holds the cutter, and a changeover unit which, in a condition in which the pen holder is holding the pen and the cutter holder is holding the cutter, reduces and increases the distance between one of the pen and cutter and the paper in comparison with the distance between the other and the paper.

4 Claims, 5 Drawing Sheets

MEDIUM PROCESSING DEVICE

CROSS-REFERENCE TO RELATED APPLICATIONS

This application claims the priority benefit of Japan application serial no. 2011-130181, filed on Jun. 10, 2011, and 2011-132642, filed on Jun. 14, 2011. The entirety of each of the above-mentioned patent applications is hereby incorporated by reference herein and made a part of this specification.

FIELD OF THE INVENTION

The present invention relates to a medium processing device which carries out processes, such as plotting and cutting, on a medium such as paper.

BACKGROUND

A plotter which carries out an exchange of pens and cutters between a pen holder included in a carriage and a magazine for housing pens or cutters is described in Patent Literature 1.

Also, a recording device which carries out plotting and cutting on recording paper is described in Patent Literature 2. In the recording device, a configuration is such that an engagement member having two engagement portions is provided in a cutter block, and by adopting a configuration wherein one engagement portion can engage with a pen block, and the other engagement portion can engage with a stopper attached to a housing, the engagement conditions of the two engagement portions are changed by an action of the pen block. That is, it is possible to hold a recording pen and a cutter pen simultaneously, and the recording pen is placed in a pen storage portion when using the cutter pen.

CITATION LIST

Patent Literature

[Patent Literature 1] JP-A-6-262899 (published on Sep. 20, 1994).

[Patent Literature 2] JP-A-8-224993 (published on Sep. 3, 1996).

SUMMARY OF INVENTION

Technical Problem

With the heretofore known technologies heretofore described, a configuration which attaches and detaches at least one of a plotting pen and a cutter is necessary. However, as an attachment and detachment structure is of a complicated configuration with a large number of parts, cost is high. Also, when the attachment and detachment structure is employed, a carriage becomes larger and heavier, requiring a carriage drive unit having a large drive force and a carriage holding mechanism with high load capacity. Also, in order to cope with dropping-off and defective holding of a tool such as a pen, a unit and measure for confirming whether or not the tool is reliably held are necessary.

Solution to Problem

Therefore, the invention has an object of providing a medium processing device which carries out a plurality of processes, such as plotting and cutting, on a medium, such as paper, wherein it is not necessary to attach or detach units which carry out the plurality of processes, thus simplifying the structure of the device.

In order to achieve the object, a medium processing device according to the invention, which carries out at least two kinds of process on a medium with a first processing unit and a second processing unit, includes a carriage including a first holding unit which holds the first processing unit; a second holding unit which holds the second processing unit; and a distance change unit which, in a condition in which the first holding unit is holding the first processing unit and the second holding unit is holding the second processing unit, reduces and increases the distance between one processing unit and the medium in comparison with the distance between the other processing unit and the medium.

According to the heretofore described configuration, it is possible, with both the first processing unit and second processing unit remaining held, to carry out a target process by bringing a processing unit which carries out the process closer to the medium. That is, there is no need for a mechanism which switches between the differing processing units, as heretofore known. Because of this, there is no need, either, for a unit or measure for confirming the attachment and detachment. Because of this, it is possible to reduce the size of the whole of a carriage conveying mechanism. Also, neither a unit which confirms whether or not the processing units have been reliably held, nor a control mechanism in a case in which the processing units have not been reliably held, is necessary in order to cope with dropping-off and defective holding of the processing units.

Therefore, it is possible to provide a simply-structured medium processing device.

In the invention, it is more preferable that the distance change unit, by causing one of the first processing unit and second processing unit to rotationally move about a certain rotation axis, changes the distance between the one processing unit and medium.

It is possible to realize the medium processing device with a structure simpler than, for example, a structure wherein the processing units are caused to move up and down independently of one another. That is, simply by causing the distance change unit to rotate, it is possible to switch between the processing units. Therefore, it is possible to simplify the structure of the medium processing device. Also, it is possible to reduce the size and weight of the medium processing device. The "rotation axis" is such that, when the distance change unit has a shaft, as in an embodiment to be described hereafter, it is sufficient for a line perpendicular to the longitudinal direction of the shaft to be used as the rotation axis, and it is preferable, from the viewpoint of an easy simplification in mechanism, to configure in such a way that the perpendicular line passes through the shaft.

In the invention, it may be arranged that the distance change unit causes one processing unit to rotationally move, and that the other processing unit does not rotationally move, and is fixed to a member other than the distance change unit.

It is possible to simplify the structure of a movable member, and thus possible to further reduce the size and weight of the medium processing device.

In the invention, it is more preferable that the carriage includes an up and down position control unit which controls the up and down positions of the first processing unit and second processing unit, and a support which transmits a force with which the up and down position control unit causes the first processing unit and second processing unit to move up and down, and that the member, other than the distance change unit, which fixes the other processing unit which is not caused to rotationally move is the support.

The other processing unit is fixed to the support by, for example, a holding unit which holds the other processing unit being fixed to the support. By fixing the other processing unit to the support, it is possible to apply a force which presses the processing unit against the medium, and thus possible to increase working accuracy. Also, there is no need to provide a member holding the processing unit separately, thus enabling a simplification in mechanism and reduction in weight of the medium processing device.

In the invention, it may be arranged that the distance change unit causes both the first processing unit and second processing unit to rotationally move, and that the rotational movement is a movement which takes the second processing unit farther from the medium when the first processing unit comes closer to the medium, and takes the first processing unit farther from the medium when the second processing unit comes closer to the medium.

Simply by attaching the two processing units to the distance change unit, which is a member which is caused to rotationally move, and causing the distance change unit to rotate, it is possible to bring a desired processing unit closer to the medium.

In the invention, it is more preferable that the carriage reciprocates on the medium, that the distance change unit, which includes two switches, brings one processing unit closer to the medium than the other processing unit by pressing one switch, and takes the one processing unit farther from the medium than the other processing unit by pressing the other switch, and that a first protruding portion is provided in a position in which one switch is pressed when the carriage, by reciprocating, reaches one end, while a second protruding portion is provided in a position in which the other switch is pressed when the carriage reaches the other end.

It is possible, when switching a target process, to switch the process by causing the carriage to move to a corresponding end. Therefore, it is possible to more easily switch a process.

In the invention, it is more preferable that the carriage includes the up and down position control unit which controls the up and down positions of the first processing unit and second processing unit, and that the up and down position control unit switches a force which presses the first processing unit or second processing unit, whichever is closer to the medium, against the medium between when pressing the first processing unit against the medium and when pressing the second processing unit against the medium.

According to this configuration, it is possible to carry out a desired process with a pressing force suitable for the process.

In the invention, it may be arranged that one of the first processing unit and second processing unit is for plotting on the medium, and the other is for cutting the medium.

The medium processing device can be optimally used as, for example, a device which carries out plotting and cutting on the medium, such as when manufacturing pattern paper.

Advantageous Effects of Invention

According to the invention, an advantage is achieved in that it is possible to provide a simply-structured medium processing device wherein there is no need to attach and detach a plurality of processing units.

DESCRIPTION OF EMBODIMENTS

Hereafter, a detailed description will be given of an embodiment of the invention.

[Structure of Cutting Plotter 1]

Figure 1:
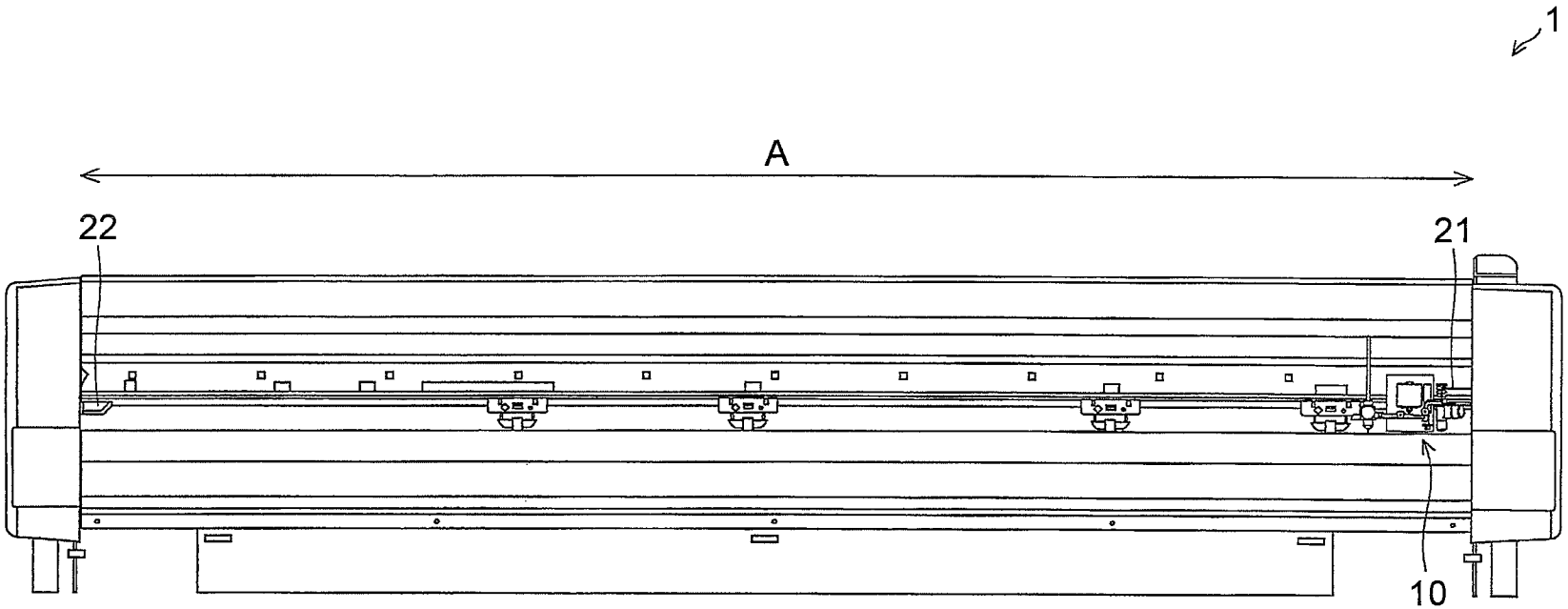
FIG. 1 is a diagram schematically showing a structure of a cutting plotter 1 according to one embodiment of the invention.

Hereafter, a description will be given, based on FIGS. 1, 2(*a*), and 2(*b*), of a structure of a cutting plotter 1 which is one embodiment according to a medium processing device of the invention. FIG. 1 is a diagram schematically showing the structure of the cutting plotter 1, and FIGS. 2(*a*) and 2(*b*) are diagrams schematically showing a structure of a carriage 10 included in the cutting plotter 1, wherein FIG. 2(*a*) is a diagram when showing a support 20, and FIG. 2(*b*) shows a structure around the circled position in FIG. 2(*a*), seen through the support 20.

As shown in FIG. 1, the cutting plotter 1 includes the carriage 10. Also, a protruding portion 21 (a first protruding portion) and a protruding portion 22 (a second protruding portion) are provided in the cutting plotter 1.

The carriage 10 reciprocates in an arrow A direction. When paper (a medium; not shown) is processed by the cutting plotter 1, the carriage 10, while reciprocating, carries out plotting and cutting processes on paper with a pen 11 (a first processing unit) and a cutter 12 (a second processing unit) which are held on the carriage 10. Media for which the medium processing device according to the invention is intended include, for example, paper such as pattern paper or cardboard, and a resin plate.

Paper is disposed immediately below the carriage 10, and fed from the back side to the near side as seen in the drawing. That is, the cutting plotter 1, while feeding the paper in a certain direction, causes the carriage 10 to reciprocate in a direction perpendicular to the direction. Data of what to plot on and how to cut the paper are recorded in advance in the cutting plotter 1, and the movements of the paper and carriage 10 and the processes with the pen 11 and cutter 12 are carried out based on the data.

Figure 2:
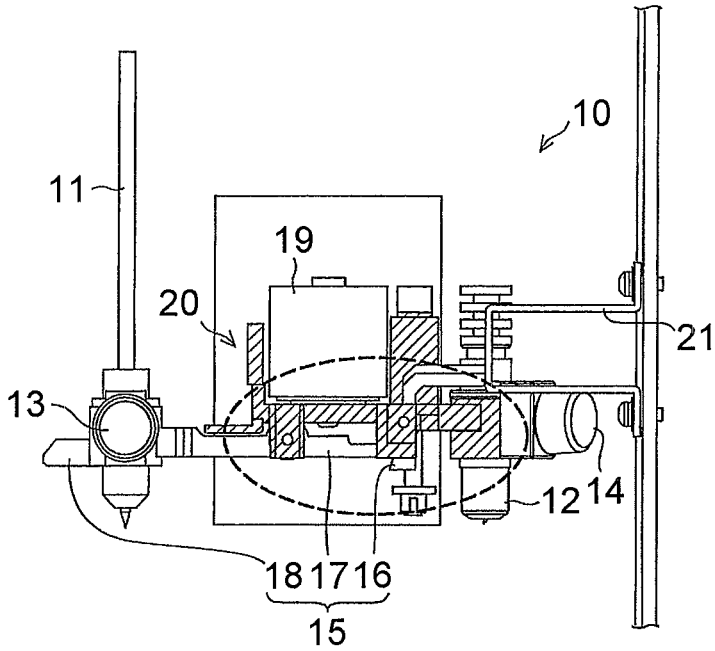
FIGS. 2(*a*) and 2(*b*) are diagrams schematically showing a structure of a carriage 10 included in the cutting plotter 1.
Figure 2:
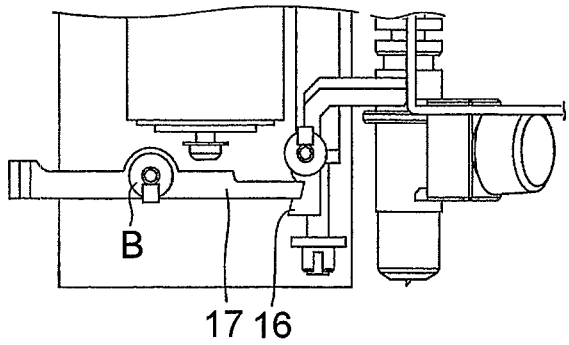

As shown in FIGS. 2(*a*) and 2(*b*), the carriage 10 includes a pen holder 13 (a first holding unit), a cutter holder 14 (a second holding unit), a changeover unit 15 (a distance change unit), a solenoid 19 (an up and down position control unit), and the support 20.

The pen holder 13 holds the pen 11. FIGS. 2(*a*) and 2(*b*) show a condition in which the pen holder 13 is holding the pen 11. A portion of the pen holder 13 which holds the pen 11 has a hollow cylinder-like shape, and the pen 11 is fixed in a condition in which it penetrates through the hollow cylinder.

The pen holder 13 can move up and down while pivoting by the changeover unit 15, to be described hereafter, operating.

The cutter holder 14 holds the cutter 12. FIGS. 2(*a*) and 2(*b*) show a condition in which the cutter holder 14 is holding the cutter 12. The cutter 12 is such that a blade is provided at a tip of a cylindrical structure. A portion of the cutter holder 14 which holds the cutter 12 has a hollow cylinder-like shape, and the cutter 12 is fixed in a condition in which it penetrates through the hollow cylinder.

As will be described hereafter, the support 20 which transmits a force from the solenoid 19 to the changeover unit 15 exists between the solenoid 19 and changeover unit 15, and the cutter holder 14 is also fixed connected to the support 20. That is, the position of the cutter holder 14 relative to the support 20 does not change. By the pen holder 13 moving up and down, it is possible to reduce and increase the distance between the pen 11 and the paper in comparison with the distance between the cutter 12 and the paper.

In this way, in the embodiment, the position of the cutter 12 relative to the support 20 is fixed, and the position of the pen 11 moves up and down. When the position of one processing unit is caused to rotationally move, and the position of the other processing unit is fixed without being caused to rotationally move, in this way, thereby reducing and increasing the distance between the one processing unit and the medium in comparison with the distance between the other processing unit and the medium, it is preferable that a processing unit, such as carries out a cutting process, which has a strong force which presses against the medium, and a processing unit requiring working accuracy, are held by an immovable unit which is not caused to rotationally move, and that a processing unit, such as a plotting tool, for which it is sufficient to have a weak force which presses against the medium, and a processing unit for which it is sufficient to have comparatively low working accuracy, are held by a movable unit, such as the pen holder 13 in the embodiment, which is caused to rotationally move. By reducing a force applied to the movable unit as much as possible, it is possible to reduce the width and thickness of a member configuring the movable unit, and thus possible to reduce the weight of the carriage.

The changeover unit 15 is configured of a switch 16, a shaft 17, and a switch 18. The changeover unit 15 reduces and increases the distance between one of the pen 11 and cutter 12 and the paper in comparison with the distance between the other and the paper. For example, the changeover unit 15 reduces and increases the distance between the pen 11 and the paper in comparison with the distance between the cutter 12 and the paper. When the distance between the pen 11 and the paper is shorter than the distance between the cutter 12 and the paper, it is possible to carry out plotting on the paper with the pen 11. When the distance between the pen 11 and the paper is longer than the distance between the cutter 12 and the paper, it is possible to cut the paper with the cutter 12.

The switch 16 has an approximately S shaped structure. A lower portion thereof has a hook structure and, by the leading end of the shaft 17 fitting in a hook, supports the shaft 17. The switch 16, when a force from outside as seen from the carriage 10 is applied to an upper portion of the switch 16, rotates counterclockwise as seen in the drawing, and the hook supporting the shaft 17 comes out of contact with the leading end of the shaft 17. Because of this, the switch 16 side end of the shaft 17 moves downward.

The shaft 17 rotates about a rotation axis B. The rotation axis B is a straight line passing through the shaft 17 and perpendicular to a longitudinal direction of the shaft 17. When the switch 16 is pressed, and the switch 16 side end of the shaft 17 moves downward, the switch 18 side end of the shaft 17 moves upward.

The switch 18 is a portion formed at the pen 11 side end of the shaft 17, at which an inclined plane is formed. When a force from outside as seen from the carriage 10 is applied to the inclined plane, the switch 18 moves up and down. The up and down movement is caused as a result of a rotational movement of the shaft 17 about the rotation axis B. That is, the switch 18 and the pen holder 13 provided thereon, by rotating about the rotation axis B, move up and down.

The solenoid 19 controls the up and down position of the whole of the changeover unit 15. The solenoid 19 causes the whole of the changeover unit 15 to move up and down via the support 20 in such a way that the leading end of the pen 11 or the leading end of the cutter 12, whichever is lower, comes into contact with the front surface of the paper when processing the paper. By so doing, the pen 11 or the cutter 12, whichever is closer to the medium, is further pressed against the medium, thus carrying out a plotting or cutting process.

The solenoid 19 can change the force which presses the pen 11 against the paper and the force which presses the cutter 12 against the paper independently of one another. That is, it is possible to press the pen 11 with a force suitable for plotting, and it is possible to press the cutter 12 against the paper with a force suitable for cutting. Furthermore, by adopting an arrangement such as to switch a drive force from the solenoid 19 in synchronization with a switching to a processing unit brought closer to the paper, it is possible to automatically apply a force suitable for a process to the processing unit. The up and down position control unit included in the medium processing device according to the invention not being limited to this kind of configuration, for example, a plurality of up and down position control units may be included, one for each processing unit, and drive forces of the plurality of up and down position control units fixed in advance, one for each processing unit.

The support 20 is a structure which transmits a force, with which the solenoid 19 causes the pen 11 and cutter 12 to move up and down, to the changeover unit 15 in such a way that the force from the solenoid 19 is applied to the changeover unit 15. The support 20 is connected to the changeover unit 15. More specifically, the support 20 is connected to the changeover unit 15 in such a way that rotations about the rotation axis B of the shaft 17 and the rotation axis of the switch 16 are secured. When pressing the changeover unit 15 against the paper, and lifting the whole of the changeover unit 15, using the solenoid 19, the pressing force and lifting force are transmitted to the changeover unit 15 via the support 20. At this time, the support 20, by moving vertically along an unshown guide in the carriage 10, transmits the forces which press and lift the pen 11 and cutter 12 to the changeover unit 15. Then, the forces from the solenoid 19 are transmitted to the pen 11 and cutter 12, and the pen 11 and cutter 12 move up and down.

Also, the support 20 is holding the cutter holder 14. That is, the support 20 fixes the position of the cutter 12 across the cutter holder 14. By so doing, it is possible to apply the force which presses the cutter 12 against the paper directly from the solenoid 19, and thus possible to increase working accuracy. Also, there is no need to provide a member holding the cutter holder 14 separately, thus enabling a simplification in mechanism and reduction in weight of the medium processing device. In the medium processing device according to the invention, when fixing one of the processing units to a member other than the distance change unit, the support 20 corresponds to the member.

[Action of Cutting Plotter 1]

Figure 3A:
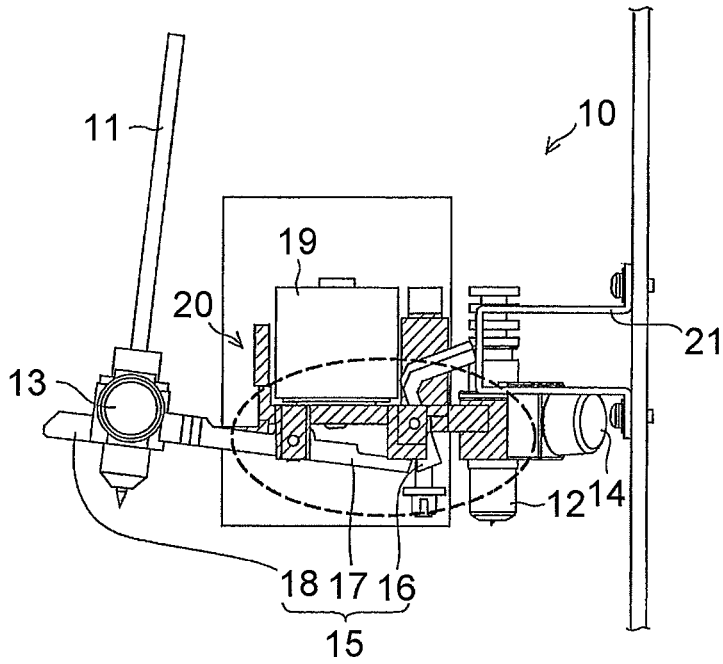
FIGS. 3(*a*) and 3(*b*) are diagrams schematically showing one example of an action of the cutting plotter 1.
Figure 3B:
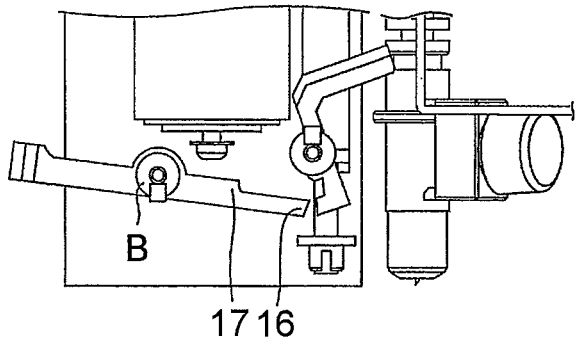

Next, a description will be given, using FIGS. 2(*a*) to 5(*b*), of an action of the cutting plotter 1. FIGS. 3(*a*) to 5(*b*) are diagrams schematically showing one example of the action of the cutting plotter 1, wherein FIGS. 3(*a*), 4(*a*), and 5(*a*) are diagrams when showing the support 20, and FIGS. 3(*b*), 4(*b*), and 5(*b*) each show a structure around the circled position in each of FIGS. 3(*a*), 4(*a*), and 5(*a*), seen through the support 20.

Firstly, a description will be given of an action when the cutting plotter 1 plots on paper. As shown in FIGS. 2(*a*) and 2(*b*), the leading end of the pen 11 is positioned to be lower than the leading end of the cutter 12. That is, the leading end of the pen 11 is closer to paper (not shown) disposed below the carriage 10 than the leading end of the cutter 12. The cutting plotter 1 feeds the paper to the near side of the plane of the drawing. At the same time, the carriage 10 reciprocates in the arrow A direction shown in FIG. 1. In order to plot in accordance with preset data, the solenoid 19 presses the whole of the changeover unit 15 downward via the support 20 while feeding the paper and causing the carriage 10 to reciprocate, thus bringing the leading end of the pen 11 into contact with the paper. By so doing, plotting is carried out.

The carriage 10 does not constantly reciprocate between two ends at which the protruding portion 21 and protruding portion 22 are provided, but after making the width of the paper narrower than a width by which the carriage 10 can reciprocate, the carriage 10 reciprocates inside a range in which it reciprocates, thereby processing the paper. When carrying out process switching, the carriage 10 moves to a corresponding end, as will be described hereafter. It may be arranged that the control of the movement is carried out manually, or that data indicating processing details are recorded in a built-in or external control unit in advance, and the control unit causes the carriage 10, based on the data, to move in accordance with processing details.

Next, a description will be given, using FIGS. 3(*a*) and 3(*b*), of an action of switching a process from plotting to cutting, thus carrying out a cutting process on paper.

When carrying out a plotting process on paper, the carriage 10 carries out a reciprocation inside the protruding portion 21 and protruding portion 22, as heretofore described, but when switching the process from plotting to cutting, the carriage 10 moves to a position in which the switch 16 is pressed by the protruding portion 21.

When the switch 16 is pressed by the protruding portion 21, a portion in contact with the protruding portion 21 moves toward the inside of the cutting plotter 1, along with which a hook structure region of the switch 16 moves toward the outside of the cutting plotter 1. The shaft 17 has been supported by the hook structure region until this movement, but this movement releases the hook, and the shaft 17 loses support. As a result of this, the switch 16 side end of the shaft 17 moves downward, and the shaft 17 pivots about the rotation axis B, while the pen 11 side end of the shaft 17 rotationally moves upward. By so doing, the pen 11 lifts, and the distance between the cutter 12 and the paper is reduced in comparison with the distance between the pen 11 and the paper. At this time, the end of the hook structure region is caught on the end of the shaft 17, thus performing the function of fixing the pen 11 so as to prevent the pen 11 from swaying.

In this way, with the cutting plotter 1, it is possible, with both the pen 11 and cutter 12 remaining held, to easily reduce and increase the distance between the one of the pen 11 and cutter 12 which carries out a process and the paper in comparison with the distance between the other and the paper.

Also, in the embodiment, it is possible to easily switch a process to be carried out on the paper from plotting to cutting, or from cutting to plotting, as will be described hereafter, simply by increasing the width of the reciprocation of the carriage 10. Therefore, the configuration of the cutting plotter 1 is very simple.

In the embodiment, a spring is provided on the switch 16 so that a force acts in a direction in which the released hook is caught on the shaft 17. Also, in order that the rotational movement of the shaft 17 is smoothly carried out, a spring is also provided on the shaft 17 in advance so that a force acts in a direction of the rotational movement.

As a result of the heretofore described action, a process to be carried out by the cutting plotter 1 switches from plotting on the paper to cutting of the paper. After having switched the processing unit closer to the paper from the pen 11 to the cutter 12, the paper is fed, and the carriage 10 is caused to reciprocate, while maintaining this condition. Furthermore, the cutter 12 is pressed against the paper by the solenoid 19 causing the whole of the changeover unit 15 to move downward when the cutter 12 is positioned above a cutting position. By so doing, the paper can be cut by the cutter 12. When carrying out cutting with the cutter 12 too, the carriage 10 carries out the reciprocation inside the protruding portion 21 and protruding portion 22.

Next, a description will be given, using FIGS. 4(*a*), 4(*b*), 5(*a*), and 5(*b*), of an action of switching a process from cutting to plotting.

The carriage 10 carries out a reciprocation inside the protruding portion 21 and protruding portion 22 when carrying out a paper cutting process, as heretofore described, but when switching the process from cutting to plotting, the carriage 10 moves to a position in which the switch 18 is pressed by the protruding portion 22.

Figure 4:
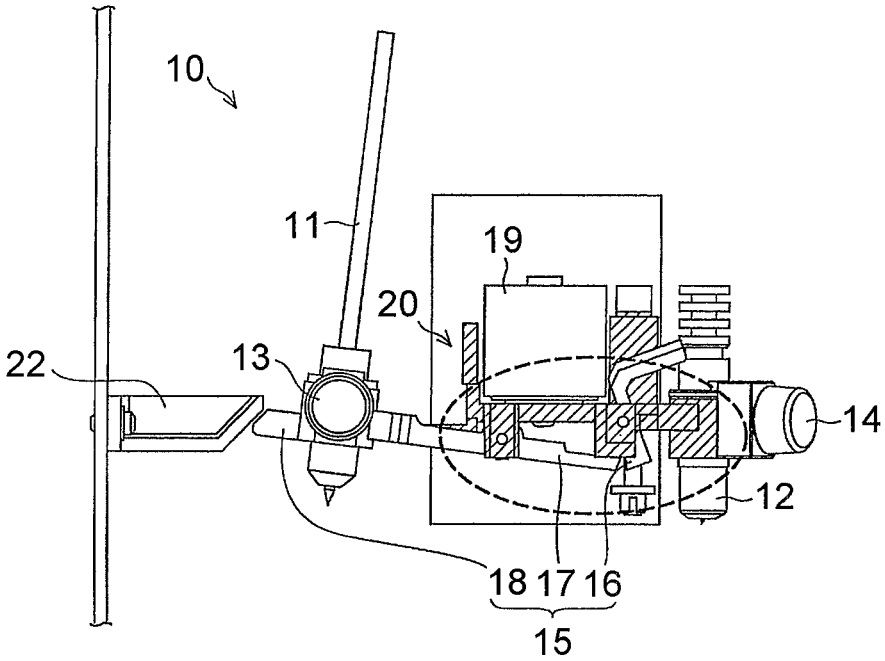
FIGS. 4(*a*) and 4(*b*) are diagrams schematically showing one example of the action of the cutting plotter 1.
Figure 4:
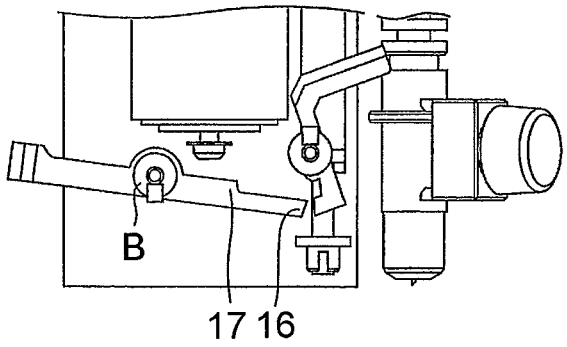

FIGS. 4(*a*) and 4(*b*) show a condition immediately before the switch 18 is pressed by the protruding portion 22. Inclined planes are provided one on each of the switch 18 and protruding portion 22 so that the planes can come into contact with each other. As heretofore described, the hook structure region of the switch 16 is caught by the end of the shaft 17, thus preventing the pen 11 swaying, until the above condition is attained.

Figure 5:
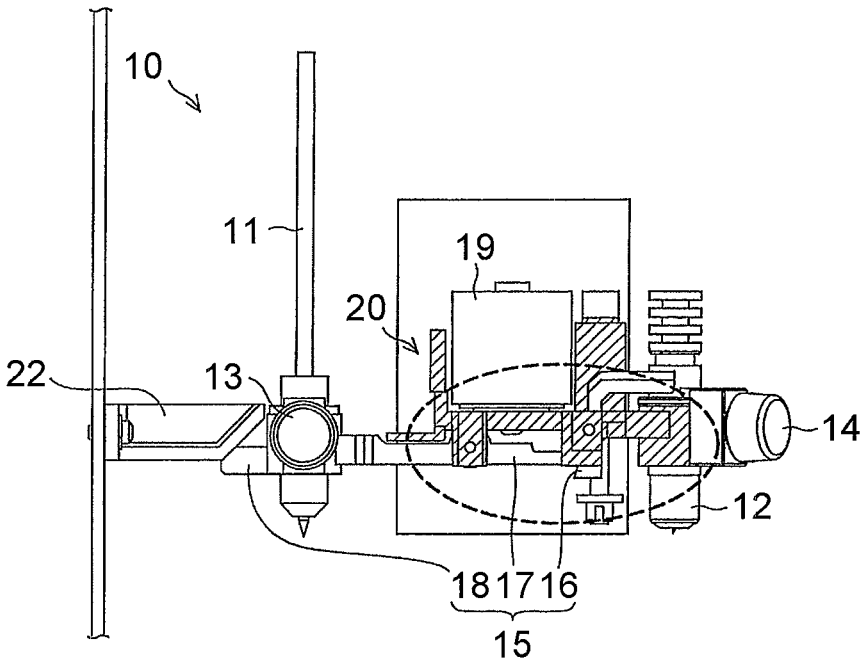
FIGS. 5(*a*) and 5(*b*) are diagrams schematically showing one example of the action of the cutting plotter 1.
Figure 5:
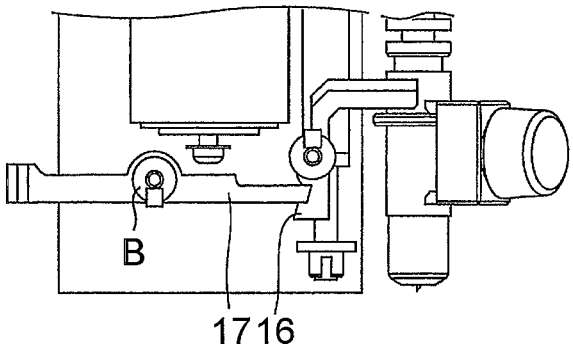

Next, when the carriage 10 further moves to the protruding portion 22 side, the switch 18 moves downward, as shown in FIGS. 5(*a*) and 5(*b*). That is, by the carriage 10 and protruding portion 22 coming still closer to each other in a condition in which the inclined plane of the switch 18 and the inclined plane of the protruding portion 22 are in contact, a downward force is applied to the inclined plane of the switch 18 by the inclined plane of the protruding portion 22, and the switch 18 moves downward.

By so doing, the pen 11 moves downward. Also, by the shaft 17 rotating about the rotation axis B, the switch 16 side end of the shaft 17 moves upward. Furthermore, at this time, the solenoid 19 applies a force which pulls up the whole of the changeover unit 15. The force continues to be applied to the switch 16 by the spring in such a way that the switch 16 returns to the position shown in FIGS. 5(*a*) and 5(*b*). That is, the switch 16 side end of the shaft 17, after having moved upward by the shaft 17 rotating and the solenoid 19 lifting the changeover unit 15, optimally fits in the hook structure region of the switch 16, and is supported by the switch 16. Then, the changeover unit 15 is fixed so that the pen 11 is positioned closer to the paper than the cutter 12.

After that, the paper is fed, and the carriage 10 is caused to reciprocate, in the condition shown in FIGS. 5(*a*) and 5(*b*), and by the solenoid 19 causing the changeover unit 15 to move downward when the pen 11 is positioned above a plotting position, the leading end of the pen 11 comes into contact with the paper. By so doing, it is possible to plot on the paper with the pen 11.

As heretofore described, in the embodiment, a description has been given of a structure wherein the distance between the cutter 12 and the paper is reduced and increased in comparison with the distance between the pen 11 and the paper by the changeover unit 15 rotating about the rotation axis B. The distance change unit included in the medium processing device according to the invention not being limited to this kind of configuration, for example, a configuration may be adopted wherein each of the pen 11 and cutter 12 is caused to move up and down. Note that, as it is possible to easily form a configuration wherein the distances are adjusted utilizing a rotation, as in the embodiment, it is possible to eliminate a larger number of parts. Also, it is possible to reduce the size and weight of the device.

Also, in the embodiment, a description has been given of a configuration wherein the protruding portion 21 and protruding portion 22 are provided one at each of two ends of a region in which the carriage 10 reciprocates, and caused to press the switch 16 and switch 18, thereby switching between the processing units. However, the medium processing device according to the invention not being limited to this kind of configuration, for example, it may be arranged that switches, one causing each of two processing units to move up and down, are provided, and that the switches are pressed manually or by a mechanical configuration such as an actuator, thereby switching between the processing units. Note that, according to the kind of configuration in the embodiment, as it is possible to easily switch between the processing units without carrying out any complicated operation on the carriage 10, there is no need for a cumbersome operation or a complicated mechanism using an actuator or the like.

Also, in the embodiment, a description has been given of a configuration wherein the cutter holder 14 is fixed to the support 20 and is not caused to rotationally move but, for example, it may be arranged that both the processing units rotationally move, such as by providing the pen holder 13 and cutter holder 14 one at either end of the shaft 17. That is, this rotational movement is a movement whereby the cutter 12 is taken farther from the paper when the pen 11 comes closer to the paper, while the pen 11 is taken farther, from the paper when the cutter 12 comes closer to the paper. With this kind of configuration, by causing the shaft 17 to rotate, the pen 11 or cutter 12, whichever processing unit carries out a target process, can be held protruded toward the paper.

<Rider>

As heretofore described, a cutting plotter 1 of one embodiment of a medium processing device according to the invention, which carries out two kinds of process on paper with a pen 11 and a cutter 12, includes a carriage 10 including a pen holder 13 which holds the pen 11; a cutter holder 14 which holds the cutter 12; and a changeover unit 15 which, in a condition in which the pen holder 13 is holding the pen 11 and the cutter holder 14 is holding the cutter 12, reduces and increases the distance between one of the pen 11 and cutter 12 and the paper in comparison with the distance between the other and the paper.

According to the heretofore described configuration, it is possible, with both the pen 11 and cutter 12 remaining held, to carry out a target process by bringing a processing unit which carries out the process closer to a medium. That is, there is no need for a mechanism which switches between the pen and cutter, as heretofore known. Because of this, there is no need, either, for a unit or measure for confirming the attachment and detachment. Because of this, it is possible to reduce the size of the carriage 10. Also, neither a unit which confirms whether or not the pen and cutter have been reliably held, nor a control mechanism in a case in which the pen and cutter have not been reliably held, is necessary in order to cope with dropping-off and defective holding of the pen and cutter. Therefore, it is possible to provide a simply-structured cutting plotter 1.

Also, in the cutting plotter 1, the changeover unit 15, by causing the pen 11 to rotationally move about a rotation axis B, changes the distance between the pen 11 and the paper.

It is possible to realize the cutting plotter 1 with a structure simpler than, for example, a structure wherein the pen 11 and cutter 12 are caused to move up and down independently of one another. That is, simply by causing the changeover unit 15 to rotate, it is possible to change which of the pen 11 and cutter 12 is to carry out a process. Therefore, it is possible to further simplify the structure of the cutting plotter 1. Also, it is possible to reduce the size and weight of the cutting plotter 1.

Also, in the cutting plotter 1, the changeover unit 15 causes the pen 11 to rotationally move, and the cutter 12 does not rotationally move, and is fixed to a support 20. It is possible to further simplify the structure of the cutting plotter 1, and thus possible to further reduce the size and weight of the cutting plotter 1.

Also, in the cutting plotter 1, the carriage 10 includes a solenoid 19 which controls the up and down positions of the pen 11 and cutter 12, and the support 20 which transmits a force with which the solenoid 19 causes the pen 11 and cutter 12 to move up and down, and a member which fixes the cutter 12 which is not caused to rotationally move is the support 20. Because of this, it is possible to apply directly from the solenoid 19 a force which presses the cutter 12 against the paper, and thus possible to increase working accuracy. There is no need to provide a member holding the cutter holder 14 separately, thus enabling a simplification in mechanism and reduction in weight of the cutting plotter 1.

Also, although differing from the heretofore described embodiment, in the cutting plotter 1, a configuration may be adopted such that the changeover unit 15 causes both the pen 11 and cutter 12 to rotationally move, and the rotational movement is a movement which takes the cutter 12 farther from the paper when the pen 11 comes closer to the paper, and takes the pen 11 farther from the paper when the cutter 12 comes closer to the paper.

Simply by attaching the pen 11 and cutter 12 to the shaft 17, which is a member which is caused to rotationally move, and causing the shaft 17 to rotate, it is possible to bring a desired processing unit closer to the paper.

Also, the carriage 10 reciprocates on the paper, the changeover unit 15, which includes a switch 16 and a switch 18, brings the cutter 12 closer to the paper than the pen 11 by pressing the switch 16, and takes the cutter 12 farther from the paper than the pen 11 by pressing the switch 18, and a protruding portion 21 is provided in a position in which the switch 16 is pressed when the carriage 10, by reciprocating, reaches one end, while a protruding portion 22 is provided in a position in which the switch 18 is pressed when the carriage 10 reaches the other end.

It is possible, when switching a target process, to switch the process by causing the carriage 10 to move to a corresponding end. Therefore, it is possible to more easily switch a process.

Also, in the cutting plotter 1, the carriage 10 includes the solenoid 19 which controls the up and down positions of the pen 11 and cutter 12, and the solenoid 19 switches a force which presses the pen 11 or cutter 12, whichever is closer to the paper, against the paper between when pressing the pen 11 against the paper and when pressing the cutter 12 against the paper. By so doing, it is possible to carry out a desired process with a pressing force suitable for the process.

Also, in the cutting plotter 1, the pen 11 is for plotting on the paper, and the cutter 12 is for cutting the paper, meaning that the cutting plotter 1 can be optimally used as, for example, a device which carries out plotting and cutting on the medium, such as when manufacturing pattern paper.

The invention, not being limited to each heretofore described embodiment, can be variously changed within the scope shown in the claims, and an embodiment obtained by appropriately combining technical units and measures disclosed in differing embodiments is also included in the technical scope of the invention.

The medium processing device according to the invention can be optimally utilized in making apparel product pattern paper, and the like.

What is claimed is:

1. A medium processing device which carries out at least two kinds of process on a medium with a first processing unit and a second processing unit, comprising:

a carriage including:

a first holding unit which holds the first processing unit;

a second holding unit which holds the second processing unit; and a distance change unit which, in a condition in which the first holding unit is holding the first processing unit and the second holding unit is holding the second processing unit, reduces and increases the distance between one processing unit and the medium in comparison with the distance between the other processing unit and the medium, wherein the distance change unit causes both the first processing unit and the second processing unit to rotationally move, and the rotational movement is a movement which takes the second processing unit farther from the medium when the first processing unit comes closer to the medium, and takes the first processing unit farther from the medium when the second processing unit comes closer to the medium.

2. The medium processing device according to claim 1, wherein, the carriage includes the up and down position control unit which controls the up and down positions of the first processing unit and second processing unit, and the up and down position control unit switches a force which presses the first processing unit or second processing unit, whichever is closer to the medium, against the medium between when pressing the first processing unit against the medium and when pressing the second processing unit against the medium.

3. The medium processing device according to claim 1, wherein, one of the first processing unit and second processing unit is for plotting on the medium, and the other is for cutting the medium.

4. A medium processing device which carries out at least two kinds of process on a medium with a first processing unit and a second processing unit, comprising:

a carriage including:

a first holding unit which holds the first processing unit;

a second holding unit which holds the second processing unit; and a distance change unit which, in a condition in which the first holding unit is holding the first processing unit and the second holding unit is holding the second processing unit, reduces and increases the distance between one processing unit and the medium in comparison with the distance between the other processing unit and the medium, wherein, the carriage reciprocates on the medium, the distance change unit, which includes two switches, brings one processing unit closer to the medium than the other processing unit by pressing one switch, and takes the one processing unit farther from the medium than the other processing unit by pressing the other switch, and a first protruding portion is provided in a position in which one switch is pressed when the carriage, by reciprocating, reaches one end, while a second protruding portion is provided in a position in which the other switch is pressed when the carriage reaches the other end.

* * * * *